US006491730B1

(12) United States Patent
Cauble, Jr. et al.

(10) Patent No.: US 6,491,730 B1
(45) Date of Patent: Dec. 10, 2002

(54) PRE-TREATMENT METHODS AND COMPOSITIONS FOR CARBON DIOXIDE DRY CLEANING

(75) Inventors: David F. Cauble, Jr., Charlotte, NC (US); James P. DeYoung, Durham, NC (US); James B. McClain, Raleigh, NC (US); Bernadette Storey-Laubach, Durham, NC (US)

(73) Assignee: Micell Technologies, Inc., Raleigh, NC (US)

( * ) Notice: Subject to any disclaimer, the term of this patent is extended or adjusted under 35 U.S.C. 154(b) by 185 days.

(21) Appl. No.: 09/621,314

(22) Filed: Jul. 20, 2000

Related U.S. Application Data

(60) Provisional application No. 60/144,624, filed on Jul. 20, 1999.

(51) Int. Cl.[7] ..... D06L 1/08

(52) U.S. Cl. ..... 8/142; 8/137; 510/283; 134/10

(58) Field of Search ..... 8/142, 139.1, 137; 510/417, 283; 134/1.3, 10

(56) References Cited

U.S. PATENT DOCUMENTS

| | | | | |
|---|---|---|---|---|
| 3,933,425 A | | 1/1976 | Grunewalder et al. | |
| 4,861,516 A | | 8/1989 | Kurzendoerfer et al. | |
| 4,877,556 A | | 10/1989 | Wilsberg et al. | |
| 5,267,455 A | * | 12/1993 | Dewees et al. | |
| 5,276,204 A | | 1/1994 | Schmid et al. | |
| 5,370,742 A | | 12/1994 | Mitchell et al. | 134/10 |
| 5,451,336 A | | 9/1995 | Schwadtke et al. | |
| 5,683,977 A | | 11/1997 | Jureller et al. | 510/286 |
| 5,858,022 A | | 1/1999 | Romack et al. | 8/142 |
| 5,908,473 A | * | 6/1999 | Weller et al. | |
| 6,030,663 A | | 2/2000 | McClain et al. | 427/389.9 |

FOREIGN PATENT DOCUMENTS

DE 39 04514 A1 8/1990

OTHER PUBLICATIONS

International Search Report dated Dec. 12, 2000; International Application No. PCT/US00/19790.

* cited by examiner

*Primary Examiner*—Gregory E. Webb
(74) *Attorney, Agent, or Firm*—Myers Bigel Sibley & Sajovec

(57) ABSTRACT

A method for dry-cleaning articles such as fabrics and clothing in carbon dioxide. The article includes a stained portion or region, which is pretreated with a pretreatment composition prior to initiating the cleaning cycle. The pretreatment step is followed by contacting the pretreated article to be cleaned with a liquid dry cleaning composition for a time sufficient to clean the article. The liquid dry-cleaning composition comprises a mixture of carbon dioxide, a surfactant, and an organic co-solvent. After the contacting step, the article is separated from the liquid dry cleaning composition. The pretreatment composition, in a preferred embodiment, comprises at least one of (a) a surfactant; (b) d-limonene, and (c) a C12–C15 alkane co-solvent. Preferably the pretreatment composition comprises at least two, and in some particularly preferred embodiments, the pretreatment composition comprises all three, of the aforesaid ingredients.

66 Claims, No Drawings

PRE-TREATMENT METHODS AND COMPOSITIONS FOR CARBON DIOXIDE DRY CLEANING

RELATED APPLICATIONS

This application claims priority from U.S. Provisional Application Serial No. 60/144,624, filed Jul. 20, 1999, the disclosure of which is incorporated by reference herein in its entirety.

FIELD OF THE INVENTION

The present invention relates to methods and compositions for carrying out the dry-cleaning of fabrics (e.g., garments) in liquid carbon dioxide.

BACKGROUND OF THE INVENTION

Commercial dry cleaning systems currently employ potentially toxic and environmentally harmful halocarbon solvents, such as perchloroethylene. Carbon dioxide has been proposed as an alternative to such systems in U.S. Pat. No. 4,012,194 to Maffei.

German Patent Application DE3904514 A1 of Schollmeyer, published Aug. 23, 1990, describes a cleaning system combining various conventional anionic or nonionic surface active agents with supercritical $CO_2$. The system described therein appears to combine the detergency mechanism of conventional surface active agents with the solvent power of supercritical fluid carbon dioxide. A carbon dioxide dry cleaning system effective for liquid carbon dioxide is not provided.

U.S. Pat. No. 5,683,473 to Jureller et al. (see also U.S. Pat. No. 5,683,977 to Jureller et al.) describes a dry cleaning system utilizing carbon dioxide in liquid form in combination with surfactants that contain a functional moiety that is $CO_2$-philic, which surfactants are not conventionally used for detergent cleaning. Since there are numerous advantages to employing conventional surfactants (e.g., cost, ready availability, established regulatory approval, established toxicology, etc), it would be extremely desirable to have a dry cleaning system for liquid carbon dioxide that employs conventional surfactants that do not contain a $CO_2$-philic group.

U.S. Pat. No. 5,858,022 to Romack et al. describes dry methods and compositions for dry cleaning in liquid carbon dioxide formulations in which a conventional surfactant (i.e., one that does not contain a $CO_2$-philic group) is used in combination with an organic co-solvent. The conventional surfactant is soluble in the organic co-solvent. Ingredients such as bleaches, whiteners, softeners, sizing, starching, enzymes, hydrogen peroxide or a source of hydrogen peroxide, are described at column 3 lines 39–43, but recommendations for the structure or composition of ingredients that are particularly advantageous in carbon dioxide cleaning formulations, as opposed to functional statements thereof, are not provided. Accordingly, there is a continued need for additives or ingredients that can be advantageously employed with carbon dioxide cleaning formulations.

SUMMARY OF THE INVENTION

A method for dry-cleaning garments or fabrics in carbon dioxide, said garment or fabric including a stained portion comprises pre-treating the stained portion of a garment or fabric article to be cleaned with a liquid pretreatment composition, said composition preferably containing a pretreatment surfactant. The pretreatment step is followed by the steps of contacting the article with a liquid dry cleaning composition for a time sufficient to clean the article, said liquid dry-cleaning composition comprising a mixture of carbon dioxide and a cleaning surfactant; and then separating the article from the liquid dry cleaning composition.

In one embodiment, the pretreatment surfactant is one which does not contain a $CO_2$-philic group. In another embodiment, the pretreatment surfactant is one which does contain a $CO_2$-philic group (e.g., a fluoropolymer or a fluorine-containing segment such as a fluoroacrylate polymer, or a siloxane polymer or siloxane containing segment), which $CO_2$-philic group is in turn coupled to a hydrophilic or lipophilic group. When present, the pretreatment surfactant (either type) is preferably included in an amount of from 0.05, 1, 2, or 3 percent to 5 or 10 percent by weight.

Without wishing to be bound to any particular theory of the invention, it is believed that surfactants that do not contain a $CO_2$-philic group remain localized in the area to which they are applied to a greater extent during the cleaning cycle in the presence of the carbon dioxide cleaning solution and facilitate holding water to the stained area, thus facilitating cleaning of the stained area during the cleaning cycle.

When the surfactant comprises a $CO_2$-philic group coupled to a lipophilic segment, the pretreatment composition is particularly useful for grease, oily stains and the like (e.g., hydrophobic stains). When the surfactant comprises a $CO_2$-philic group coupled to a hydrophilic segment, the pretreatment composition is particularly useful for protein and tanin-type stains and the like (e.g., hydrophilic stains).

In another embodiment of the invention, the pretreatment surfactant is a poly(ether-carbonate) copolymer. Again, when present, the pretreatment surfactant is preferably included in an amount of from 1, 2, or 3 percent to 5 or 10 percent by weight of the total formulation (the surfactant may be one or a combination of surfactants as described above).

Preferably, the cleaning composition comprises (or further comprises, in addition to the surfactants noted above) an organic co-solvent. Particularly preferred organic co-solvents are C12–C15 alkane co-solvents. When present, such organic co-solvents are preferably included in an amount of from 2, 30 or 40 percent to 70, 80 or 90 percent by volume.

In another embodiment, the pretreatment composition contains d-limonene, either alone or, more preferably, in combination with an organic co-solvent (particularly a C12–15 alkane co-solvent as above), and/or a surfactant as noted above. When present, the d-limonene is included in the pretreatment composition in an amount of from 5 or 10 percent to 30, 40 or 50 percent, by volume.

The balance of the pretreatment compositions described above may comprise water.

A particularly preferred pretreatment composition includes both an organic co-solvent as described above and d-limonene as described above. Such a composition optionally but preferably also includes a surfactant or surfactants as described above.

DETAILED DESCRIPTION OF THE INVENTION

The term "pretreatment" as used herein refers to contacting a pretreatment composition, typically a liquid, to a stained portion or particular region of an article to be cleaned so that the pretreatment composition is deposited on that portion or region in an amount effective to enhance subsequent cleaning of the article, and then continuing or initiating further dry cleaning of that article with the pretreatment composition deposited upon the article to be cleaned.

The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particular soils (i.e., soils containing insoluble solid components such as silicates, carbon black, etc.).

Articles that can be pretreated and cleaned by the methods of the present invention are, in general, garments and fabrics (including woven and non-woven) formed from materials such as cotton, wool, silk, leather, rayon, polyester, acetate, fiberglass, furs, etc., formed into items such as clothing, work gloves, rags, leather goods (e.g., handbags and brief cases), etc.

The present invention may be carried out in any suitable carbon-dioxide based dry cleaning system, such as those described in U.S. Pat. Nos. 5,858,022 to Romack et al. or 5,683,473 to Jureller et al., the disclosures of which are incorporated by reference herein in their entirety.

1. Cleaning Compositions and Processes.

Liquid dry-cleaning compositions useful for carrying out the present invention typically include water. The source of the water is not critical in all applications. The water may be added to the liquid solution before the articles to be cleaned are deposited therein, may be atmospheric water, may be the water carried by the garments, etc.

In one embodiment of the invention, better particulate cleaning may be obtained in the absence of water added to the dry-cleaning composition. There is inherently water present on or in the garments or articles to be cleaned as they are placed in the cleaning vessel. This water serves in part to adhere particulate soil to the articles to be cleaned. As the water is removed from the garments into the cleaning composition during the cleaning process, the removal of water from the article to be cleaned facilitates the removal of particulates from the articles to be cleaned. Thus, decreasing the amount of water originally in the cleaning system can serve to facilitate the cleaning of particulate soil from the articles to be cleaned by the action of the water inherently carried by the article to be cleaned.

Liquid dry-cleaning compositions useful for carrying out the present invention typically comprise:

(a) from zero (0), 0.02, 0.05 or 0.1 to 5 or 10 percent (more preferably from 1 to 4 percent) water;

(b) carbon dioxide (to balance; typically at least 30 percent);

(c) surfactant (preferably from 0.1 or 0.5 percent to 5 or 10 percent total, which may be comprised of one or more different surfactants); and (d) from 0.1 to 50 percent (more preferably 1, 2 or 4 percent to 30 percent) of an organic co-solvent.

Percentages herein are expressed as percentages by weight unless otherwise indicated.

The composition is provided in liquid form at ambient, or room, temperature, which will generally be between zero and 50° Centigrade. The composition is held at a pressure that maintains it in liquid form within the specified temperature range. The cleaning step is preferably carried out with the composition at ambient temperature. For the purposes of the invention, the pretreatment composition may be a heterogeneous or homogeneous composition.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes. Additional compounds such as one or more alcohols (e.g., from 0 or 0.1 to 5% of a C1 to C15 alcohol (including diols, triols, etc.)) different from the organic co-solvent may be included with the organic co-solvent.

Examples of suitable co-solvents include, but are not limited to, aliphatic and aromatic hydrocarbons, and esters and ethers thereof, particularly mono and di-esters and ethers (e.g., EXXON ISOPAR L, ISOPAR M, ISOPAR V, EXXON EXXSOL, EXXON DF 2000, CONDEA VISTA LPA-170 N, CONDEA VISTA LPA-210, cyclohexanone, and dimethyl succinate), alkyl and dialkyl carbonates (e.g., dimethyl carbonate, dibutyl carbonate, di-t-butyl dicarbonate, ethylene carbonate, and propylene carbonate), alkylene and polyalkylene glycols, and ethers and esters thereof (e.g., ethylene glycol-n-butyl ether, diethylene glycol-n-butyl ethers, propylene glycol methyl ether, dipropylene glycol methyl ether, tripropylene glycol methyl ether, and dipropylene glycol methyl ether acetate), lactones (e.g., (gamma)butyrolactone, (epsilon)caprolactone, and (delta) dodecanolactone), alcohols and diols (e.g., 2-propanol, 2-methyl-2-propanol, 2-methoxy-2-propanol, 1-octanol, 2-ethyl hexanol, cyclopentanol, 1,3-propanediol, 2,3-butanediol, 2-methyl-2,4-pentanediol) and polydimethylsiloxanes (e.g., decamethyltetrasiloxane, decamethylpentasiloxane, and hexamethyldisloxane), etc.

Any surfactant can be used to carry out the present invention, including both surfactants that contain a $CO_2$-philic group (such as described in PCT Application WO96/27704) linked to a $CO_2$-phobic group (e.g., a lipophilic group or hydrophobic group) and (more preferably) surfactants that do not contain a $CO_2$-philic group (i.e., surfactants that comprise a hydrophilic group linked to a hydrophobic (typically lipophilic) group). A single surfactant may be used, or a combination of surfactants may be used.

Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, heterocyclic-type products, imidazolines and imidazoline derivatives, isethionates, lanolin-based derivatives, lecithin and lecithin derivatives, lignin and lignin derivatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates, ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

Additional examples of surfactants that can be used to carry out the present invention include alcohol and alkylphenol polyalkyl ethers (e.g, TERGITOL 15-S-3™ secondary alcohol ethoxylate, TRITON X-207™ dinonylphenol ethoxylate, NEODOL 91-2.5™ primary alcohol ethoxylate, RHODASURF BC-410™ isotridecyl alcohol ethoxylate, RHODASURF DA-630™ tridecyl alcohol ethoxylate) alkylaryl carbonates, including salts and derivatives thereof (e.g., acetic acid, MARLOWET 4530™ dialkylphenol polyethylene glycol acetic acid, MARLOWET 1072™ alkyl polyethylene glycol ether acetic acid), alkoxylated fatty acids (e.g., NOPALCOL 1 TW™ diethylene glycol monotallowate, TRYDET 2600™ polyoxyethylene (8) monostearate), alkylene oxide block copolymers (e.g., PLURONIC™ and TETRONIC™ products), acetylenic alcohols and diols (e.g., SURFYNOL™ and DYNOL™ products), mono- and di-esters of sulfosuccinic acid (e.g., AEROSOL OT™ sodium dioctyl sulfosuccinate, AEROSOL IB-45™ sodium diisobutyl sulfosuccinate, MACKANATE DC-50™ dimethicone copolyol disodium sulfosuccinate, SOLE TERGE-8™ oleic acid isopropanolamide monoester of sodium sulfosuccinate), sulfosuccinamic acid and esters thereof (e.g. AEROSOL 18™ disodium-N-octadecyl sulfosucciniamate, AEROSOL 22™ tetrasodium N-(1,2-dicarboxyethyl)-N octadecyl sulfosuccinamate) sorbitan esters including derivatives thereof (e.g., SPAN 80™ sorbitan monoleate, ALKAMULS 400-DO™ sorbitan dioleate, ALKAMULS STO™ sorbitan trioleate, TWEEN 81™ polyoxyethylene (5) sorbitan monoleate, TWEEN 21™ polyoxyethylene (4) sorbitan monolaurate), isothionates including derivatives thereof (e.g., GEROPON AC-270™ sodium cocoyl isothionate), polymeric alkylaryl compounds and lignins, including derivatives thereof (e.g., LIGNOSITE 50™ calcium lignosulfonate), alkylaryl sulfonic acids and salts thereof (e.g., CALIMULSE EM-99™ branched dodecylbenzene sulfonic acid, WITCONATE C-50H™ sodium dodecylbenzene sulfonate, WITCONATE P10-59™ amine salt of dodecylbenzene sulfonate), sulfonated amines and amides (e.g., CALIMULSE PRS™ isopropylamine sulfonate), Betaine and sultaine derivatives, and salts thereof (e.g, lauryl sulfobetaine, dodecyldimethyl(3-sulfopropyl) ammonium hydroxide, FOAMTAIN CAB-A™ cocamidopropyl betaine ammonium salt, FOAMTAINE SCAB™ cocamidopropyl hydroxy sultaine), e.g., imidazolines including derivatives thereof (e.g., MONOAZOLINE O™ substituted imidazoline of oleic acid, MONOAZOLINE T™ substituted imidazoline of Tall Oil), oxazolines including derivatives thereof (e.g., ALKATERGE E™ oxazoline derivative, ALKATERGE T-IV™ ethoxylated oxazoline derivative), carboxylated alcohol or alkylphenol ethoxylates including derivatives thereof (e.g., MARLOSOL OL7™ oleic acid polyglycol ester), diphenyl sulfonates including derivatives thereof (e.g., DOWFAX™ detergent diphenyl oxide disulfonate, DOWFAX™ dry detergent: sodium n-hexadecyl diphenyl oxide disulfonate, DOWFAX™ Dry hydrotrope: sodium hexyl diphenyloxide disulfonate) fluorinated surfactants (e.g., FLUORAD FC-120™ ammonium perfluoroalkyl sulfonate, FLUORAD FC-135™ fluoroalkyl quaternary ammonium iodides, FLUORAD FC-143™ ammonium perfluoroalkyl carboxylates), lecithins including lecithin derivatives (e.g., ALCOLEC BS™ soy phosphatides), phosphate esters (e.g., ACTRAFOS SA-216™ aliphatic phosphate ester, ACTRAFOS 110™ phosphate ester of complex aliphatic hydroxyl compound, CHEMPHOS TC-310™ aromatic phosphate ester, CALGENE PE-112™ phosphated mono- and diglycerides), sulfates and sulfonates of fatty acids (e.g, ACTRASOL PSR™ sulfated castor oil, ACTRASOL SR75™ sulfated oleic acid), sulfates of alcohols (e.g, DUPONOL C™ sodium lauryl sulfate, CARSONOL SHS™ sodium 2-ethyl-1-hexyl sulfate, CALFOAM TLS-40™ triethanolamine lauryl sulfate), sulfates of ethoxylated alcohols (e.g, CALFOAM ES-301™ sodium lauryl ether sulfate), amines, including salts and derivatives thereof (e.g., Tris(hydroxymethyl) aminomethane, ARMEEN™ primary alkylamines, ARMAC HT™ acetic acid salt of N-alkyl amines) amide sulfonates (e.g., GEROPON TC-42™ sodium N-coconut acid-N-methyl taurate, GEROPON TC270™ sodium cocomethyl tauride), quaternary amines, including salts and derivatives thereof (e.g., ACCOSOFT 750™ methyl bis (soya amidoethyl)-N-polyethoxyethanol quaternary ammonium methyl sulfate, ARQUAD™ N-alkyl trimethyl ammonium chloride, ABIL QUAT 3272™ diquaternary polydimethylsiloxane), amine oxides (e.g, AMMONYX CO™ cetyl dimethylamine oxide, AMMONYX SO™ stearamine oxide), esters of glycerol, sucrose, glucose, sarcosine and related sugars and hydrocarbons including their derivatives (e.g., GLUCATE DO™ methyl glucoside dioleate, GLICEPOL 180™ glycerol oleate, HAMPOSYL AL-30™ ammonium lauroyl sarcosinate, HAMPOSYL M™ N-myristoyl sarcosine, CALGENE CC™ propylene glycol dicaprylate/dicaprate), polysaccharides including derivatives thereof (e.g., GLUCOPON 225 DK™ alkyl polysaccharide ether), protein surfactants (e.g, AMITER LGS-2™ dioxyethylene stearyl ether diester of N-lauroyl-L-glutamic acid, AMISOFT CA™ cocoyl glutamic acid, AMISOFT CS 11™ sodium cocoyl glutamate, MAYTEIN KTS™ sodium/TEA lauryl hydrolyzed keratin, MAYPON 4C™ potassium cocoyl hydrolyzed collagen), and including thio and mercapto derivatives of the foregoing (e.g., ALCODET™ polyoxyethylene thioether, BURCO TME™ ethoxylated dodecyl mercaptan), etc. Thus the present invention may be carried out using conventional surfactants, including but not limited to the anionic or nonionic alkylbenzene sulfonates, ethoxylated alkylphenols and ethoxylated fatty alcohols described in Schollmeyer German Patent Application DE 39 04514 A1.

Surfactants that contain a $CO_2$-philic group are described are known in the art and described in, for example, J. DeSimone et al., *Science* 265, 356 (1994), U.S. Pat. No. 5,312,882 to DeSimone et al., U.S. Pat. No. 5,683,473 to Jureller et al. and U.S. Pat. No. 5,683,977 to Jureller et al.

As will be apparent to those skilled in the art, numerous additional ingredients can be included in the dry-cleaning composition, including detergents, bleaches, whiteners, softeners, sizing, starches, enzymes, hydrogen peroxide or a source of hydrogen peroxide, fragrances, etc.

In practice, in a preferred embodiment of the invention, an article to be cleaned and a liquid dry cleaning composition as given above are combined in a closed drum. The liquid dry cleaning composition is preferably provided in an amount so that the closed drum contains both a liquid phase and a vapor phase (that is, so that the drum is not completely filled with the article and the liquid composition). The article is then agitated in the drum, preferably so that the article contacts both the liquid dry cleaning composition and the vapor phase, with the agitation carried out for a time sufficient to clean the fabric. The cleaned article is then removed from the drum. The article may optionally be rinsed (for example, by removing the composition from the drum, adding a rinse solution such as liquid $CO_2$ (with or without additional ingredients such as water, co-solvent, etc.) to the drum, agitating the article in the rinse solution, removing the rinse solution, and repeating as desired), after the agitating step and before it is removed from the drum. The dry cleaning compositions and the rinse solutions may be removed by any suitable means, including both draining and venting.

Any suitable cleaning apparatus may be employed, including both horizontal drum and vertical drum apparatus. When the drum is a horizontal drum, the agitating step is carried out by simply rotating the drum. When the drum is a vertical drum it typically has an agitator positioned therein, and the agitating step is carried out by moving (e.g., rotating or oscillating) the agitator within the drum. A vapor phase may be provided by imparting sufficient shear forces within the drum to produce cavitation in the liquid dry-cleaning composition. Finally, in an alternate embodiment of the invention, agitation may be imparted by means of jet agitation as described in U.S. Pat. No. 5,467,492 to Chao et al., the disclosure of which is incorporated herein by reference. A particularly preferred apparatus is described in U.S. Pat. No. 6,049,331 to McClain et al. As noted above, the liquid dry cleaning composition is preferably an ambient temperature composition, and the agitating step is preferably carried out at ambient temperature, without the need for associating a heating element with the cleaning apparatus.

2. Pretreatment Compositions and Processes.

In one embodiment, a liquid pre-treatment composition useful for carrying out the present invention typically comprises:

(a) water (to balance; typically at least 30, 40 or 50 percent);

(b) a surfactant (preferably from 0.1 or 0.5 percent to 5 or 10 percent total, which may be comprised of one or more different surfactants); and (c) from zero (0) or 1 to 40 percent (more preferably 2 or 4 percent to 30 percent) of an organic co-solvent)(or in another preferred embodiment from 30 or 40 to 80 percent by volume), with C12–C15 alkane cosolvents particularly preferred.

The surfactant and any organic co-solvent may be any of those described above in connection with the cleaning formulations, or the surfactant may be a poly(ether-carbonate) copolymer as described below.

In one embodiment, the surfactant contains a $CO_2$-philic group as noted above. In another embodiment, the surfactant does not contain a $CO_2$-philic group.

Surfactants that do not contain a $CO_2$-philic group are particularly useful in pretreatment formulations in carbon dioxide dry cleaning processes. Without wishing to be bound to any particular theory of the instant invention, it is believed that such surfactants advantageously remain localized in the stained area to which they are applied during the washing cycle and hold water therewith, facilitating cleaning of the stained location. These considerations are separate and distinct from those involved in the selection of a surfactant that does not contain a $CO_2$-philic group in the cleaning formulation, as noted above.

Additional ingredients can be included depending upon the specific stain that is being treated, in accordance with known formulations.

The pretreatment formulation currently preferred for miscellaneous food and protein stains is a mixture consisting of (% w/w) 74.8% water, 18.5% ISOPAR M™ organic solvent, 1.9% TERGITOL™ 15-S-3 Surfactant; 0.9% TERGITOL™ 15-S-7 surfactant; 0.9% TERGITOL™ 15-S-9 Surfactant, 1% Lipolase, 1% Alcolase, and 1% Temamyl.

The currently preferred tannin specific pretreatment (% w/w) is a mixture consisting of 73.3% water, 18% ISOPAR M™ organic solvent, 1.9% 15-S-3, 0.(% 15-S-7, 0.9% 15-S-9, and 5% glycolic acid.

In another embodiment, a liquid pre-treatment composition useful for carrying out the present invention typically comprises:

(a) water (to balance);

(a) from 30 or 40 percent to 80 percent by volume of an organic co-solvent (preferably a C12–C15 alkane cosolvent);

(b) from 5 or 10 to 40 or 50 percent by volume of d-limonene;

(c) optionally, but preferably, a surfactant as described above (preferably from 0.1 0.5, 1, 2 or 3 percent to 5 or 10 percent total by weight, which may be comprised of one or more different surfactants); and (d) optionally, water (to balance, typically 0 or 1 to 10, 20 or 40 percent by volume).

Again, the surfactant and organic co-solvent may any of those described above in connection with the cleaning formulations or the surfactant may be a poly(ether-carbonate) copolymer as described below.

The pretreatment formulations can be conveniently provided in a squeeze bottle or spray container for use by dry cleaning personnel and application to garments prior to their being deposited in the dry cleaning apparatus. The pretreatment composition can simply be applied to a stained region of an article to be cleaned, with or without scrubbing or brushing, and the article deposited in the dry cleaning apparatus for subsequent cleaning.

The formulations noted above are useful in aiding the removal of a variety of stains, including spaghetti sauce, some types of pen ink, some types of make-up, coffee, miscellaneous food drippings and miscellaneous bodily fluids. They leave little or no residue on garments relative to commercially available pretreatments, and do not result in undue damage to garments.

The formulations and methods described herein are particularly useful for treating garments, fabrics and the like that have previously been provided with a water or stain-resistant coating, such as described in U.S. Pat. No. 6,030,663 to McClain.

3. Poly(ether-carbonate) Copolymers as Pretreatment and Cleaning Surfactants.

A non-fluorine, non-siloxane class of surfactants for $CO_2$ that show amphiphilic character in $CO_2$ are poly(ether-carbonate) copolymers. These materials can be derived from the catalytic polymerization of alkylene oxides with $CO_2$ and are known in the art. See, e.g., T. Sarbu, *Nature* 405, 165–168 (2000). With catalyst controls amphiphilic poly (ether-carbonate) copolymers with hydrophilic character can be generated as represented by the formula:

$$(—R^1—O—)x—(R^2—O—CO_2)y$$

Where $R^1$ and $R^2$ are each independently alkylene oxide (preferably propylene oxide, ethylene oxide, or hexylene oxide (the R groups can comprise a mixture of the three), and x and y are selected to provide the desired molecular weight as noted below. Such materials may be used as both pretreatment surfactants in the pretreatment formulation disclosed herein or as cleaning surfactants in the carbon dioxide cleaning formulations disclosed herein. Preferred copolymers for use in the present invention have a molecular weight of 200 or 500 to 2,000 or 10,000.

The present invention is explained in greater detail in the following non-limiting examples.

EXAMPLE 1

Carbon Dioxide Dry-Cleaning Composition

An example of a liquid carbon dioxide dry cleaning system that can be used to carry out the present invention is a mixture that contains:

4.2% ISOPAR M™ organic solvent;

0.24% water;

0.196% TRITON™ RW-20 (commercial detergent available from Union Carbide; a secondary amine ethoxylate);

0.048% TRITON™ GR-7 M detergent (a commercial detergent of Union Carbide; sodium dioctyl sulfosuccinate in aromatic and aliphatic hydrocarbons)

0.48% TERGITOL™ 15-S-3 detergent (a commercial detergent of Union Carbide; a secondary alcohol ethoxylate); and liquid carbon dioxide to balance.

EXAMPLE 2

Carbon Dioxide Dry-Cleaning Composition

An additional example of a liquid carbon dioxide dry cleaning system that can be used to carry out the present invention is a mixture that contains:

3.07% ISOPAR M™ organic solvent;

1.32% DPMA (diopropylene glycol monomethyl ether acetate);

0.087% water;

0.023% TRITON™ GR-7 M detergent (a commercial detergent of Union Carbide; sodium dioctyl sulfosuccinate in aromatic and aliphatic hydrocarbons)

0.5% TERGITOL™ 15-S-3 detergent (a commercial detergent of Union Carbide; a secondary alcohol ethoxylate); and liquid carbon dioxide to balance.

EXAMPLE 3

Carbon Dioxide Dry-Cleaning Composition

An additional example of a liquid carbon dioxide dry cleaning system that can be used to carry out the present invention, particularly useful for the cleaning of particulate soil, is a mixture that contains:

4.2% ISOPAR M™ organic solvent;

0.196% TRITON™ RW-20 (commercial detergent available from Union Carbide; a secondary amine ethoxylate);

0.048% TRITON™ GR-7M detergent (a commercial detergent of Union Carbide; sodium dioctyl sulfosuccinate in aromatic and aliphatic hydrocarbons)

0.48% TERGITOL™ 15-S-3 detergent (a commercial detergent of Union Carbide; a secondary alcohol ethoxylate); and liquid carbon dioxide to balance.

EXAMPLE 4

Carbon Dioxide Dry-Cleaning Composition

An additional example of a liquid carbon dioxide dry cleaning system that can be used to carry out the present invention, also particularly useful for cleaning particulate soil, is a mixture that contains:

3.07% ISOPAR M™ organic solvent;

1.32% DPMA (diopropylene glycol monomethyl ether acetate);

0.023% TRITON™ GR-7M detergent (a commercial detergent of Union Carbide; sodium dioctyl sulfosuccinate in aromatic and aliphatic hydrocarbons)

0.5% TERGITOL™ 15-S-3 detergent (a commercial detergent of Union Carbide; a secondary alcohol ethoxylate); and liquid carbon dioxide to balance.

EXAMPLE 5

Food and Protein Stain Pretreatment Liquid

The pretreatment formulation currently used for miscellaneous food and protein stains is a mixture consisting of (% w/w) 74.8% water, 18.5% ISOPAR M™ organic solvent, 1.9% TERGITOL™ 15-S-3 Surfactant; 0.9% TERGITOL™ 15-S-7 surfactant; 0.9% TERGITOL™ 15-S-9 Surfactant, 1% Lipolase, 1% Alcolase, and 1% Temamyl. Articles stained with food or protein stains are pretreated with such a composition by squirting or spraying the pretreatment liquid on the stained region, brushing if desired, and depositing the article in a cleaning apparatus for subsequent cleaning with a composition as described in Examples 1–4 above.

EXAMPLE 6

Food and Protein Stain Pretreatment Liquid

The current tannin specific pretreatment (% w/w) is a mixture consisting of 73.3% water, 18% ISOPAR M™ organic solvent, 1.9% 15-S-3, 0.(% 15-S-7, 0.9% 15-S-9, and 5% glycolic acid. Articles stained with food or protein stains are pretreated with such a composition by squirting or spraying the pretreatment liquid on the stained region, brushing if desired, and depositing the article in a cleaning apparatus for subsequent cleaning with a composition as described in Examples 1–4 above.

EXAMPLES 7–13

Pretreatments with Poly(ether-carbonate) Copolymers and D-limonene

EXAMPLE 7

A pretreatment formulation consisting of 10% of a triblock copolymer as represented above, 3% Tergitol 15-S-3 and 87% water is delivered to a swatch stained with grape juice. The swatch is then cleaned in a liquid $CO_2$ dry cleaning process such as the MICARE® cleaning process (available from Micell, Inc., 7516 Precision Drive, Raleigh, N.C. USA 27613). Once retrieved, the soil is determined to be about 95% removed (by weight) compared to about 25% for a similar soil swatch cleaned but not pretreated.

EXAMPLE 8

A pretreatment formulation consisting of 10% of a polymer derived from the catalytically controlled polymerization of propylene oxide and $CO_2$, 25% of d-limonene, and 65% of a C12 to C15 aliphatic hydrocarbon is sprayed onto a swatch that is soiled with a heavy industrial grease with dark particulate. The swatch is then cleaned in the MICARE® cleaning process and once removed the soil is determined to be about 98% removed. This compares to 60% removal on a swatch cleaned but not pretreated.

EXAMPLE 9

A pretreatment formulation consisting of 60% aliphatic hydrocarbon composed of C12 to C15 materials, 35% d-limonene, and 5% Tergitol 15-s-3 is applied liberally to a grease stain on a textile. The textile is then cleaned using the MICARE® process. After completion of the process, the soil is substantially completely removed.

EXAMPLE 10

A pretreatment formulation comprises a mixture as follows:

75% Water;

19% ISOPAR M® aliphatic hydrocarbon co-solvent (C12–C15);

2% DPMA (dipropylene glycol methyl ether acetate)

2% Tergitol 15-S-3

2% of a copolymer generated from the radical copolymerization of a 1,1,2,2,-tetrahydroperfluoroalkyl acrylate, Polyethylene glycol methacrylate, butyl acrylate, and steryl acrylate in a molar ratio of (0.5, 0.3, 1, 1)

The formulation is applied to a combination of protein and tannin based soils that were pre-applied to several fabrics. The fabrics were then cleaned in the MICARE® cleaning system and the stains were evaluated versus similar stains cleaned but not pretreated with the formulation. The non-pretreated stains were determined to be about 10 to 50% removed after the cleaning process. The pretreated stains were about 40 to 100% removed after the cleaning process.

EXAMPLE 11

A pretreatment formulation comprises a mixture as follows:

75% Water;

19% C12–C15 Aliphatic hydrocarbon cosolvent;

2% Ether or ester capped alkylene oxide cosolvent (DPM-dipropylene glycol monomethyl ether, DPMA-dipropylene glycol methyl ether acetate);

2% Alkyl/alkylene oxide block A/B non-ioinc surfactant (15-s-3, 15-s-5, 15-s7, Neodol, etc.); and 2% of a copolymer generated by the radical copolymerization of a 1,1,2,2,tetrahydroperfluoroalkyl acrylate, a lipophilic comonomer, and a hydrophilic comonmer.

EXAMPLE 12

A pretreatment formulation comprises a mixture as follows:

75% Water;

21% Isopar M hydrocarbon cosolvent;

2% Tergitol 15-S-3 surfactant; and

2% PDMS-PEG (MW=600 g/mol) Polydimethyl Siloxane-Polyethylene glycol block copolymer.

The formulation is applied to a combination of protein and tannin based soils that were pre-applied to several fabrics. The fabrics were then cleaned in the MICARE® dry cleaning system (available from Micell Technologies Inc., 7516 Precision Drive, Raleigh, N.C. 27613) and the stains were evaluated versus similar stains cleaned but not pretreated with the formulation. The non-pretreated stains were determined to be 10 to 50% removed after the cleaning process. The pretreated stains were 60 to 100% removed after the cleaning process.

EXAMPLE 13

A pretreatment formulation comprises a mixture as follows:

75% water

21% Aliphatic hydrocarbon (C12–C15)

2% Alkyl/alkylene oxide block A/B non-ioinc surfactant (15-s-3, 15-s-5, 15-s-7, Neodol, etc.)

2% PDMS-Polyalkylene oxide copolymer (polyalkyl= ethylene, propylene)

EXAMPLES 14–15

Detergent Formulation for $CO_2$ Dry Cleaning

EXAMPLE 14

A poly (ether-carbonate) copolymer as described above is added to a liquid $CO_2$ dry cleaning apparatus at a concentration of 1.0% along with water at 0.40% and $CO_2$ at 98.6%. A swatch containing a water soluble food dye is added to a rotating cleaning drum along with other fabric pieces. The liquid mixture is then circulated through the cleaning drum and additional water is added to the circulating fluid to bring the water concentration up to 0.80%. After a period of 10 minutes with adequate circulation and agitation, the liquid is drained and the swatch is removed. Essentially one hundred percent of the food dye was removed from the fabric.

EXAMPLE 15

A poly(ether-carbonate) copolymer as described above is added to a liquid $CO_2$ dry cleaning apparatus at a concentration of 1.0% along with water at 0.40%, an aliphatic hydrocarbon cosolvent at 2%, and $CO_2$ at 96.6%. A swatch containing a water soluble food dye is added to a rotating cleaning drum along with other fabric pieces. The liquid mixture is then circulated through the cleaning drum and additional water is added to the circulating fluid to bring the water concentration up to 0.80%. After a period of 10 minutes with adequate circulation and agitation, the liquid is drained and the swatch is removed. Essentially one—hundred percent of the food dye was removed from the fabric.

The foregoing is illustrative of the present invention, and is not to be construed as limiting thereof. The invention is defined by the following claims, with equivalents of the claims to be included therein.

That which is claimed is:

1. A method for dry-cleaning garments or fabrics in carbon dioxide said garment or fabric including a stained portion, said method comprising:

pretreating said stained portion with a liquid pretreatment composition, said composition containing at least 30% water by weight, and a pretreatment surfactant, wherein said pretreatment surfactant does not contain a $CO_2$-philic group;

contacting said article with a liquid dry cleaning composition for a time sufficient to clean the article, said liquid dry-cleaning composition comprising a mixture of carbon dioxide and a cleaning surfactant; and then separating the article from the liquid dry cleaning composition.

2. A method according to claim 1, wherein said pretreatment composition is an aqueous composition.

3. A method according to claim 1, wherein said pretreatment composition is a homogeneous composition.

4. A method according to claim 1, wherein said pretreatment composition is a heterogeneous composition.

5. A method according to claim 1, wherein said liquid dry cleaning composition is at a temperature of 0° C. to 30° C.

6. A method according to claim 1, said pretreatment composition further comprising an organic co-solvent.

7. A method according to claim 1, said pretreatment composition further comprising a C12–C15 alkane cosolvent.

8. A method according to claim 1, wherein said contacting step is carried out by jet agitation.

9. A method for dry-cleaning garments or fabrics in carbon dioxide, said garment or fabric including a stained portion, said method comprising:

(a) pretreating said stained portion with a liquid pretreatment composition, said composition containing at least 30% water by weight, and a pretreatment surfactant, wherein said pretreatment surfactant does not contain a $CO_2$-philic group;

(b) combining a garment or fabric article to be cleaned and a liquid dry cleaning composition in a closed drum so that said closed drum contains both a liquid phase and a vapor phase, said liquid dry cleaning composition comprising a mixture of liquid carbon dioxide and a cleaning surfactant;

(c) agitating said article in said drum so that said article contacts both said liquid dry cleaning composition and said vapor phase for a time sufficient to clean said article; and then (d) removing the cleaned article from said drum.

10. A method according to claim 9, wherein said pretreatment composition is an aqueous composition.

11. A method according to claim 9, wherein said pretreatment composition is a homogeneous composition.

12. A method according to claim 9, wherein said pretreatment composition is a heterogeneous composition.

13. A method according to claim 9, wherein said drum is a horizontal rotating drum, and said agitating step is carried out by rotating said drum.

14. A method according to claim 9, wherein said drum is a vertical drum having an agitator positioned therein, and said agitating step is carried out by moving said agitator.

15. A method according to claim 9, wherein said pretreatment composition further comprises an organic cosolvent.

16. A method according to claim 9, wherein said pretreatment composition further comprises a C12–C15 alkane cosolvent.

17. A method for dry-cleaning garments or fabrics in carbon dioxide, said garment or fabric including a stained portion, said method comprising:

pretreating said stained portion with a liquid pretreatment composition, wherein said composition comprises 5 to 75% by volume d-limonene;

contacting said article with a liquid dry cleaning composition for a time sufficient to clean the article, said liquid dry-cleaning composition comprising a mixture of carbon dioxide and a cleaning surfactant; and then separating the article from the liquid dry cleaning composition.

18. A method according to claim 17, wherein said pretreatment composition is an aqueous composition.

19. A method according to claim 17, wherein said pretreatment composition is a homogeneous composition.

20. A method according to claim 17, wherein said pretreatment composition is a heterogeneous composition.

21. A method according to claim 17, said pretreatment composition further comprising an organic co-solvent.

22. A method according to claim 17, said pretreatment composition further comprising a C12–C15 alkane co-solvent; wherein said limonine is included in an amount of from 5 to 40 percent by volume; and said alkane co-solvent is included in an amount of 30 to 80 percent by volume.

23. A method according to claim 22, said pretreatment composition further comprising 1 to 10 percent by weight of surfacatant.

24. A method for dry-cleaning garments or fabrics in carbon dioxide, said garment or fabric including a stained portion, said method comprising:

(a) pretreating said stained portion with a liquid pretreatment composition, said composition containing a pretreatment surfactant, wherein said composition comprises 5 to 75 percent by volume of d-limonene;

(b) combining a garment or fabric article to be cleaned and a liquid dry cleaning composition in a closed drum so that said closed drum contains both a liquid phase and a vapor phase, said liquid dry cleaning composition comprising a mixture of liquid carbon dioxide and a cleaning surfactant;

(c) agitating said article in said drum so that said article contacts both said liquid dry cleaning composition and said vapor phase for a time sufficient to clean said article; and then (d) removing the cleaned article from said drum.

25. A method according to claim 24, wherein said pretreatment composition is an aqueous composition.

26. A method according to claim 24, wherein said pretreatment composition is a homogeneous composition.

27. A method according to claim 24, wherein said pretreatment composition is a heterogeneous composition.

28. A method according to claim 24, wherein said drum is a horizontal rotating drum, and said agitating step is carried out by rotating said drum.

29. A method according to claim 24, wherein said drum is a vertical drum having an agitator positioned therein, and said agitating step is carried out by moving said agitator.

30. A method according to claim 24, wherein said liquid dry cleaning composition is a room-temperature composition and said agitating step is carried out at a temperature of 0° C. to 30° C.

31. A method according to claim 24, wherein said pretreatment composition further comprises an organic co-solvent.

32. A method according to claim 24, said pretreatment composition further comprising a C12–C15 alkane co-solvent; wherein said limonine is included in an amount of from 5 to 40 percent by volume; and said alkane co-solvent is included in an amount of 30 to 80 percent by volume.

33. A method according to claim 32, said pretreatment composition further comprising 1 to 10 percent by weight of surfactant.

34. A method for dry-cleaning garments or fabrics in carbon dioxide, said garment or fabric including a stained portion, said method comprising:

pretreating said stained portion with a liquid pretreatment composition, said composition containing a pretreatment surfactant, wherein said pretreatment surfactant comprises a poly(ether-carbonate) copolymer;

contacting said article with a liquid dry cleaning composition for a time sufficient to clean the article, said liquid dry-cleaning composition comprising a mixture of carbon dioxide and a cleaning surfactant; and then separating the article from the liquid dry cleaning composition.

35. A method according to claim 34, wherein said pretreatment composition is an aqueous composition.

36. A method according to claim 34, wherein said pretreatment composition is a homogeneous composition.

37. A method according to claim 34, wherein said pretreatment composition is a heterogeneous composition.

38. A method according to claim 34, wherein said liquid dry cleaning composition is at a temperature of 0° C. to 30° C.

39. A method according to claim 34, said pretreatment composition further comprising an organic co-solvent.

40. A method according to claim 34, said pretreatment composition further comprising a C12–C15 alkane cosolvent.

41. A method according to claim 1, wherein said contacting step is carried out by jet agitation.

42. A method for dry-cleaning garments or fabrics in carbon dioxide, said garment or fabric including a stained portion, said method comprising:

(a) pretreating said stained portion with a liquid pretreatment composition, said composition containing a pretreatment surfactant, wherein said pretreatment surfactant comprises a poly (ether-carbonate copolymer);

(b) combining a garment or fabric article to be cleaned and a liquid dry cleaning composition in a closed drum so that said closed drum contains both a liquid phase and a vapor phase, said liquid dry cleaning composition comprising a mixture of liquid carbon dioxide and a cleaning surfactant;

(c) agitating said article in said drum so that said article contacts both said liquid dry cleaning composition and said vapor phase for a time sufficient to clean said article; and then (d) removing the cleaned article from said drum.

43. A method according to claim 42, wherein said pretreatment composition is an aqueous composition.

44. A method according to claim 42, wherein said pretreatment composition is a homogeneous composition.

45. A method according to claim 42, wherein said pretreatment composition is a heterogeneous composition.

46. A method according to claim 42, wherein said drum is a horizontal rotating drum, and said agitating step is carried out by rotating said drum.

47. A method according to claim 42, wherein said drum is a vertical drum having an agitator positioned therein, and said agitating step is carried out by moving said agitator.

48. A method according to claim 42, wherein said liquid dry cleaning composition is a room-temperature composition and said agitating step is carried out at a temperature of 0° C. to 30° C.

49. A method according to claim 42, wherein said pretreatment composition further comprises an organic cosolvent.

50. A method according to claim 42, wherein said pretreatment composition further comprises a C12–C15 alkane cosolvent.

51. A method for dry-cleaning garments or fabrics in carbon dioxide, said garment or fabric including a stained portion, said method comprising:

pretreating said stained portion with a liquid pretreatment composition, said composition containing at least 30% water by weight, and a pretreatment surfactant, wherein said pretreatment surfactant contains a $CO_2$-philic group, said $CO_2$-philic group selected from the group consisting of fluorine-containing segments and siloxane containing segments;

contacting said article with a liquid dry cleaning composition for a time sufficient to clean the article, said liquid dry-cleaning composition comprising a mixture of carbon dioxide and a cleaning surfactant; and then separating the article from the liquid dry cleaning composition.

52. A method according to claim 51, wherein said pretreatment composition is an aqueous composition.

53. A method according to claim 51, wherein said pretreatment composition is a homogeneous composition.

54. A method according to claim 51, wherein said pretreatment composition is a heterogeneous composition.

55. A method according to claim 51, said pretreatment composition further comprising an organic co-solvent.

56. A method according to claim 51, said pretreatment composition further comprising a C12–C15 alkane cosolvent.

57. A method according to claim 51, wherein said contacting step is carried out by jet agitation.

58. A method for dry-cleaning garments or fabrics in carbon dioxide, said garment or fabric including a stained portion, said method comprising:

(a) pretreating said stained portion with a liquid pretreatment composition, said composition containing at least 30% water by weight, and a pretreatment surfactant, wherein said pretreatment surfactant contains a $CO_2$-philic group, said $CO_2$-philic group selected from the group consisting of fluorine-containing segments and siloxane containing segments;

(b) combining a garment or fabric article to be cleaned and a liquid dry cleaning composition in a closed drum so that said closed drum contains both a liquid phase and a vapor phase, said liquid dry cleaning composition comprising a mixture of liquid carbon dioxide and a cleaning surfactant;

(c) agitating said article in said drum so that said article contacts both said liquid dry cleaning composition and said vapor phase for a time sufficient to clean said article; and then (d) removing the cleaned article from said drum.

59. A method according to claim 58, wherein said pretreatment composition is an aqueous composition.

60. A method according to claim 58, wherein said pretreatment composition is a homogeneous composition.

61. A method according to claim 58, wherein said pretreatment composition is a heterogeneous composition.

62. A method according to claim 58, wherein said drum is a horizontal rotating drum, and said agitating step is carried out by rotating said drum.

63. A method according to claim 58, wherein said drum is a vertical drum having an agitator positioned therein, and said agitating step is carried out by moving said agitator.

64. A method according to claim 58, wherein said liquid dry cleaning composition is a room-temperature composition and said agitating step is carried out at a temperature of 0° C to 30° C.

65. A method according to claim 58, wherein said pretreatment composition further comprises an organic cosolvent.

66. A method according to claim 48, wherein said pretreatment composition further comprises a C12–C15 alkane cosolvent.

* * * * *